US005109557A

United States Patent [19]

Koy et al.

[11] Patent Number: 5,109,557

[45] Date of Patent: May 5, 1992

[54] NURSING PILLOW

[76] Inventors: Alison M. Koy, 8855 N. Lamon Ave., Skokie, Ill. 60077; Tracy K. Johnson, 1662 Crestridge Dr., Littleton, Colo. 80121; Julie Mumaugh, 8047 W. Harvard Dr., Lakewood, Colo. 80227

[21] Appl. No.: 545,449

[22] Filed: Apr. 23, 1990

Related U.S. Application Data

[63] Continuation of Ser. No. 279,494, Dec. 5, 1988, abandoned.

[51] Int. Cl.[5] ..... A47C 20/00

[52] U.S. Cl. ..... 5/655; 5/646

[58] Field of Search ..... 5/431, 434, 436, 94

[56] References Cited

U.S. PATENT DOCUMENTS

| | | | |
|---|---|---|---|
| D. 94,702 | 2/1935 | Marks | 5/434 |
| 1,787,832 | 5/1929 | Mueller | 5/434 |
| 3,417,413 | 12/1968 | Gage | 5/434 |
| 4,060,863 | 12/1977 | Craig | 5/436 |
| 4,606,088 | 8/1986 | Michaelsen | 5/434 |
| 4,731,890 | 3/1988 | Roberts | 5/431 |
| 4,794,657 | 1/1989 | Avery | 5/431 |
| 4,799,275 | 1/1989 | Sprague | 5/431 |
| 5,029,351 | 7/1991 | Weber | 5/431 |

FOREIGN PATENT DOCUMENTS

| | | | |
|---|---|---|---|
| 2030448 | 4/1980 | United Kingdom | 5/434 |

*Primary Examiner*—Renee S. Luebke
*Assistant Examiner*—F. Saether

[57] ABSTRACT

A boot shaped pillow for use by a mother or some other person to aid in feeding an infant. The pillow is intended to rest on the person's lap and curve around his or her abdomen while the person is seated. The person rests his or her arm on the pillow and with the same arm supports the infant for an optimal feeding position. The pillow is made of a plurality of layers which together provide a constant firmness and machine washability.

5 Claims, 1 Drawing Sheet

NURSING PILLOW

This application is a continuation in part of parent application Ser. No. 07/279,494 which was filed Dec. 5, 1988, now abandoned.

BACKGROUND-FIELD OF INVENTION

This invention relates to a pillow, specifically to such a pillow that elevates a person's arm while cradling an infant to make bottle or breast feeding more comfortable.

It is very common that when a mother (or alternate person) is nursing or bottle feeding a baby, her arm may become uncomfortable, stiff and sometimes, painful from holding up the weight of the baby. Because of the difficulty in finding a cushion in the appropriate shape and size, there is a great need for such a cushion to accommodate the mothers (or alternates) needs for comfort while feeding the infant. It is feasible that other pillows can be substituted, however, it is difficult to find one with continuous firmness, yet soft and compact enough so as not to become cumbersome.

This pillow is also unique in that it hugs the mothers (or alternates) abdomen so to provide constant support for her forearm and ultimately the infants head cradled across the mothers (or alternates) forearm or wrist and hand.

SUMMARY OF THE INVENTION

The pillow is made for the purpose of allowing the mother and child maximum comfort while nursing or bottle feeding the infant. The pillow is boot shaped with the leg portion being approximately one third narrower and one quarter longer than the foot.

While in a seated position, the foot rests on the mothers (or alternates) leg and curves around her abdomen so the narrow portion of the pillow lends support to her arm. It is essential that the firmness be constant throughout the pillow for ultimate comfort. It is vital that the pillow be constructed of machine washable components to ascertain the apparatus can remain clean for feedings in a convenient manner.

BACKGROUND-DESCRIPTION OF PRIOR ART

U.S. Pat. No. 4,731,890, issued to Roberts, is a pillow adapted for nursing mothers, however, the pillow was made to support the back of the mother and to form an infant support surface. The pillow is also soft to permit the weight of the infant to deform the upper surface of the pillow. Roberts pillow is not washable and extends from the back to the arm, limiting support to the arm. Applicants pillow curves around the abdomen as a mothers (alternates) arm does while cradling an infant. This design gives complete support to the mothers forearm. Applicants pillow is flat on top and bottom so as to allow ease in positioning on mothers lap, yet allows complete comfort without effort.

DESCRIPTION OF THE ILLUSTRATED EMBODIMENT

Figure 1:
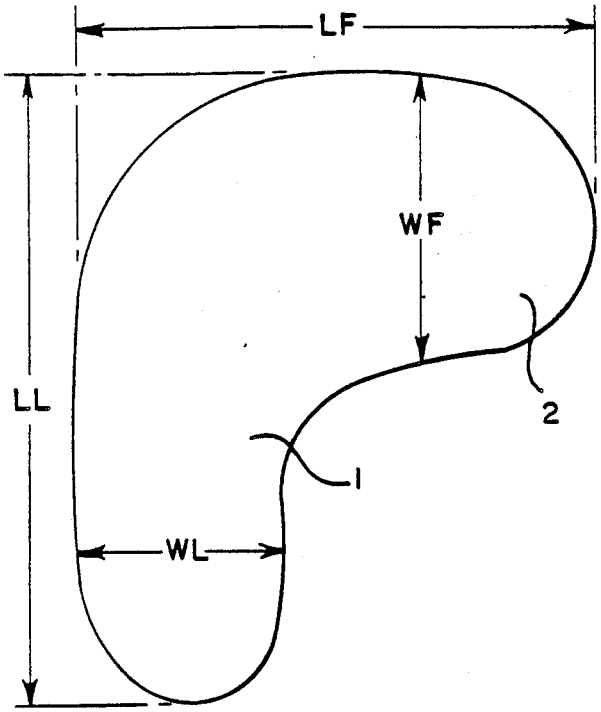
FIG. 1 is a top view of the pillow.
Figure 2:
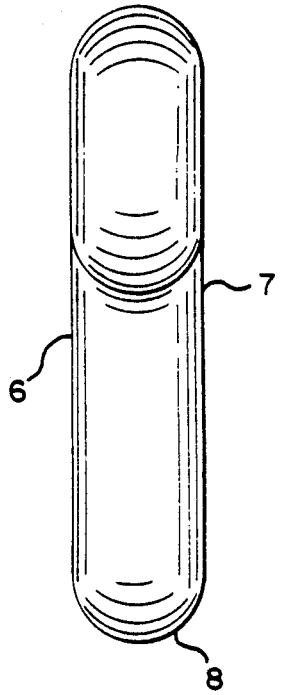
FIG. 2 is a top view with a portion broken away.
Figure 3:
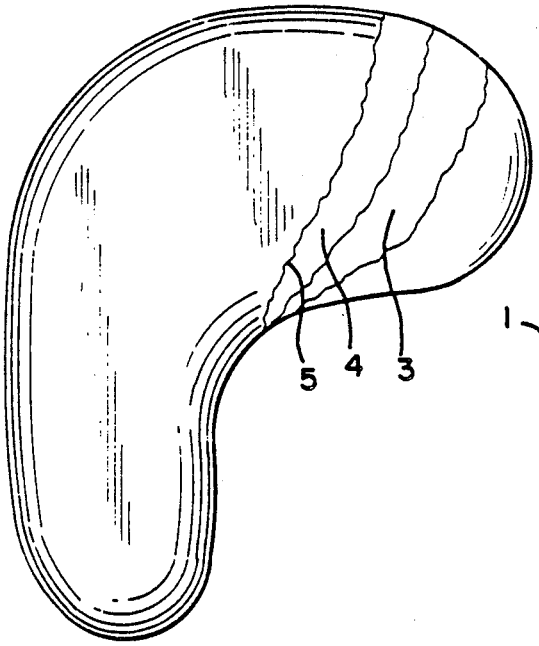
FIG. 3 is a side view of the pillow.
Figure 4:
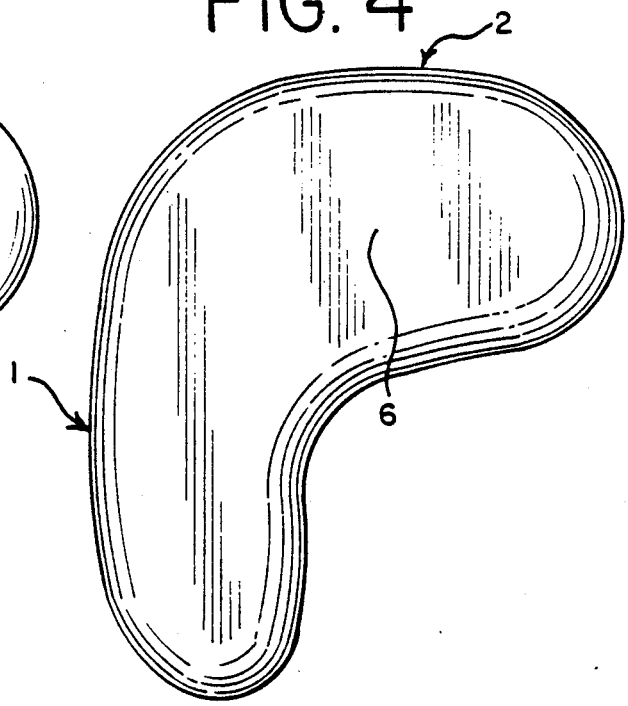
FIG. 4 is a plum view of the pillow.

FIG. 1 shows a pillow with a boot shaped appearance having a long narrow leg with a foot. The foot has a length LF which is about $\frac{3}{4}$ of the length LL of the leg and a width WF about $\frac{1}{3}$ wider than the width of the leg WL. The pillow includes a core 3 made of a material which is firm, but not hard. A foam substance or compressed and fused fibers work well, however, any sturdy, firm, washable substance can be used. The pillow has a flat top 6 and a bottom 7 surface and is curved around the edges and corners 8 joining the surface as shown in FIG. 3.

The core is encapsulated by a soft, plush, washable wrap 4. The wrap is wrapped around the core thus doubling the size of the pillow center and creating a squash feeling to the pillow.

The exterior consists of a machine washable fabric 5, tightly encasing the inner two layers to retain the shape of the pillow. A preshrunk cotton or a cotton/polyester fabric works well, but a washable quilted fabric can give added softness. Any washable material can be used for the shell.

Varying materials, fabrics and sizes can be used, as long as the components are all washable and the sizes are proportionate for the object of use.

We claim:

1. A process of using a pillow to help support a persons arm during the feeding of an infant wherein said pillow has the same firmness throughout and comprises: a firm core encompassed in a squash wrap and surrounded tightly by a fabric which forms the exterior of the pillow and retains it in a boot shape including a foot portion and a narrow leg portion, said pillow having flat top and flat bottom surfaces which are parallel and connected by curved edges, said narrow leg portion is about $\frac{1}{3}$ as wide as said foot portion and said foot portion is about $\frac{3}{4}$ the length of said narrow leg portion; the steps comprising:

placing the pillow on an individuals lap while the individual is seated;

wrapping the foot portion around the abdomen of the individual;

placing an arm of the individual on the pillow in such a manner that the individuals elbow would rest on the narrow leg portion of said pillow and resulting in the individuals wrist nesting on the foot of the pillow; and cradling an infant in the arm that is placed on said pillow.

2. A process of using a pillow according to claim 1 wherein the core is made of foam.

3. A process of using a pillow according to claim 1 wherein the core is made of a washable material.

4. A process of using a pillow according to claim 1 wherein the squash wrap is made of a washable material.

5. A process of using a pillow according to claim 1 wherein the fabric is washable.

* * * * *